US009944357B2

(12) United States Patent
Tosetti et al.

(10) Patent No.: US 9,944,357 B2
(45) Date of Patent: Apr. 17, 2018

(54) MOORING ARRANGEMENT AND YOKE FOR SAID MOORING ARRANGEMENT

(71) Applicant: SINGLE BUOY MOORINGS INC., Marly (CH)

(72) Inventors: Yves Tosetti, La Turbie (FR); Jean-Pierre Benoit, Cagnes sur Mer (FR); Pierre Balleraud, Nice (FR); Olivier Allio, Nice (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 15/028,861

(22) PCT Filed: Jun. 24, 2014

(86) PCT No.: PCT/EP2014/063221
§ 371 (c)(1),
(2) Date: Apr. 12, 2016

(87) PCT Pub. No.: WO2015/055327
PCT Pub. Date: Apr. 23, 2015

(65) Prior Publication Data

US 2016/0251061 A1 Sep. 1, 2016

(30) Foreign Application Priority Data

Oct. 15, 2013 (EP) ..... 13188631

(51) Int. Cl.
*B63B 21/00* (2006.01)
*B63B 21/50* (2006.01)

(52) U.S. Cl.
CPC ..... *B63B 21/50* (2013.01); *B63B 21/00* (2013.01); *B63B 2021/002* (2013.01); *B63B 2221/22* (2013.01)

(58) Field of Classification Search
CPC ..... B63B 21/50; B63B 21/00; B63B 2221/22; B63B 2021/002
See application file for complete search history.

(56) References Cited

U.S. PATENT DOCUMENTS 4,516,942 A * 5/1985 Pedersen ..... B63B 22/021 441/5
5,381,750 A * 1/1995 Pollack ..... B63B 21/507 114/230.12

(Continued)

FOREIGN PATENT DOCUMENTS

CN 87201244 U 1/1988
GB 2 087 819 A 6/1982

(Continued)

OTHER PUBLICATIONS

International Search Report, dated Oct. 9, 2014, from corresponding PCT Application.

*Primary Examiner* — Anthony D Wiest
(74) *Attorney, Agent, or Firm* — Young & Thompson

(57) ABSTRACT

An arrangement for mooring, loading and unloading of a vessel, includes a structure connected to the seabed and a Y-formed yoke for connecting the vessel to the structure, the structure including a stationary inner element adapted to be fixedly connected to the sea bed and an outer element having a rotatable fastening to the inner element, the outer element having a connector for fixing the yoke, wherein the yoke is provided with a pitch articulation to fix the first or mutual end of the yoke to the connector of the outer element and a roll articulation positioned between the pitch articulation and the first and second leg to allow the legs to rotate along the longitudinal axis of the yoke with respect to the pitch articulation.

13 Claims, 7 Drawing Sheets

(56) References Cited

U.S. PATENT DOCUMENTS

Figure 1:
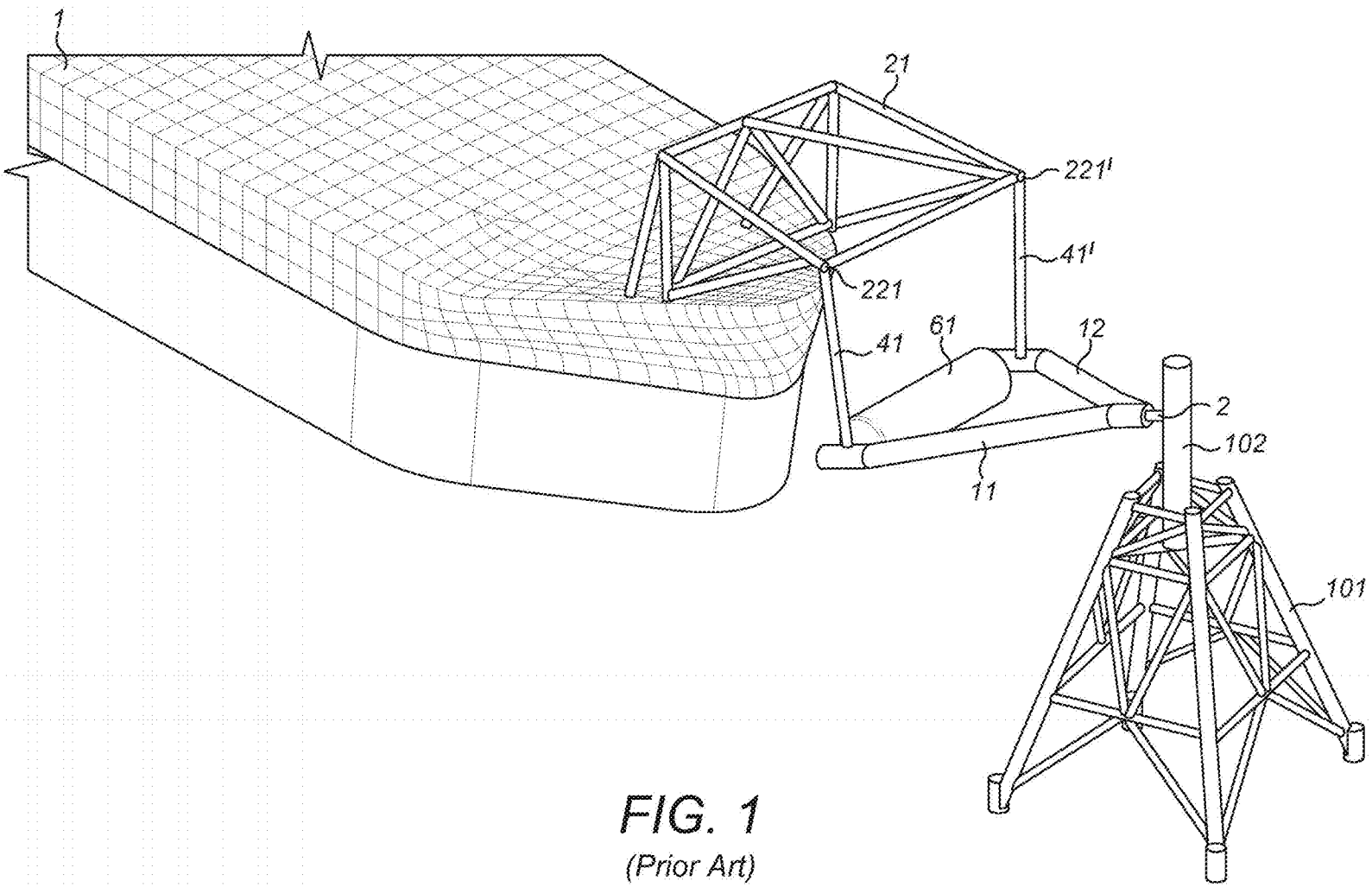
FIG. 1 (Prior Art)

| | | | | |
|---|---|---|---|---|
| 6,932,015 | B2 | 8/2005 | Storvoll et al. | |
| 8,998,662 | B2 * | 4/2015 | Deckard | F16C 33/74 384/130 |
| 2008/0108446 | A1 | 5/2008 | Faude | |
| 2014/0014017 | A1 * | 1/2014 | Balleraud | B63B 22/025 114/230.15 |

FOREIGN PATENT DOCUMENTS

| | | | |
|---|---|---|---|
| GB | 2 198 407 | A | 6/1988 |
| GB | 2 330 566 | A | 4/1999 |
| WO | 2010/042074 | A1 | 4/2010 |

* cited by examiner

MOORING ARRANGEMENT AND YOKE FOR SAID MOORING ARRANGEMENT

The invention relates to an arrangement for mooring, loading and unloading of a vessel, comprising a structure connected to the seabed and a Y-formed yoke with a first and a second yoke arm for connecting the vessel to the structure, the structure comprising a stationary bottom element adapted to be fixedly connected to the sea bed and a top element having a rotatable fastening to the bottom element, the element having a receptacle for fixing the yoke, wherein the yoke is provided with a pitch articulation to fix the yoke tip to said receptacle of the top element and a roll articulation positioned between the pitch articulation and the first and second yoke arms to allow the yoke arms to rotate along the longitudinal axis of the yoke with respect to the pitch articulation.

FIELD OF THE INVENTION

The mooring arrangement according to the present invention is typically used to moor a FPSO type vessel at a mooring location. The vessel will be connected to the mooring arrangement by means of a series of hoses and mooring legs connected to the bow of the vessel.

Hoses for the transfer of fluids, including cables for the transfer of electric power and signals, will extend out of the vessel and hang as catenary lines towards the top of the mooring arrangement according to the invention. The mooring arrangement will be partially geo-stationary in that the mooring arrangement comprises a bottom element which is to be fixed to the sea bed. The mooring arrangement further comprises a top element, rotatable connected to said bottom element. The top element is provided with connecting means, in the form of a receptacle, to allow the connecting of a yoke to the top element.

The yoke used for connecting the vessel to the connector of the outer element has typically a Y-shaped form. The yoke tip is adapted to be connected to the top element. From this yoke tip, two arms extend in the direction of the vessel, these yoke arms form the V-shaped part of the Y-shaped yoke.

The arrangement is adapted to allow the top element and the connected yoke to rotate around the geo-stationary bottom element. With the vessel connected to the yoke, the arrangement will allow the vessel to weathervane with respect to the seabed.

A mooring arrangement as described in the introduction, is known in the prior art. The mooring arrangement is for instance disclosed in the document U.S. Pat. No. 6,932,015.

Mooring arrangements which are typically used in the prior art comprise a pitch articulation for connecting the yoke to the top element. Moreover, they have a roll articulation for allowing rotation of the yoke arms with respect to this pitch articulation. The roll articulation of mooring arrangements according to the prior art are typically provided with a roller bearing.

Roller bearings are adapted to withstand relatively large forces and often provide a long service lifetime. However, the specific use of a roller bearing for the roll articulation for the mooring arrangement described in the introduction may lead to inconveniences. The main disadvantage related to the use of a roller bearing is the fact that the roller bearing may suffer from lack of maintenance due to poor access and poor lubrication.

Lubrication issues come from the unusual bearing orientation of the roll articulation in the mooring arrangement. The effect of this orientation is that the rollers and raceways may not be properly lubricated. Moreover, because of the harsh environments where the mooring arrangements are used, in combination with the accumulation of debris, possible water ingress and the presence of foreign particles may accelerate possible damages to rollers and race ways.

It is the object of the present invention to avoid some of the problems related to mooring arrangements according to the prior art.

SHORT DESCRIPTION OF THE INVENTION

An arrangement for mooring, loading and unloading of a vessel, comprising a structure connected to the seabed and a Y-formed yoke having a first and a second arm for connecting the vessel to the structure, the structure comprising a stationary bottom element adapted to be fixedly connected to the sea bed and a top element having a rotatable fastening to the bottom element, the top element being connected to the yoke, through both a yoke tip pitch articulation, positioned between a turntable and the yoke tip, and a roll articulation positioned between the pitch articulation and the first and second yoke arms, to allow the yoke arms to rotate along the longitudinal axis of the yoke with respect to the pitch articulation, the roll articulation comprising a first and a second articulation element rotatable fixed one around the other wherein the first and the second articulation elements are connected by means of friction pads.

According to a possible embodiment of the invention, the first articulation element of said roll articulation is rigidly connected to the yoke tip and wherein the second articulation element of said roll articulation is rigidly connected to said first and second yoke arms.

According to a possible embodiment of the invention, the first and the second articulation elements of the roll articulation are connected to each other by means of at least a first series of friction pads for transferring radial forces and a second series of friction pads for transferring axial forces.

According to a possible embodiment of the invention, the first and the second roll articulation elements are essentially conically shaped.

According to a preferred embodiment, both yoke pitch and roll articulations are combined into one assembly.

According to a preferred embodiment, the frictions pads are adapted to be removed and replaced one at a time, in situ, without requiring shutdown.

According to a second aspect, the invention relates to a yoke adapted for the mooring arrangement according to the invention.

According to a third aspect, the invention relates to a roll articulation adapted for the yoke according to the invention.

SHORT DESCRIPTION OF THE DRAWINGS

Figure 2:
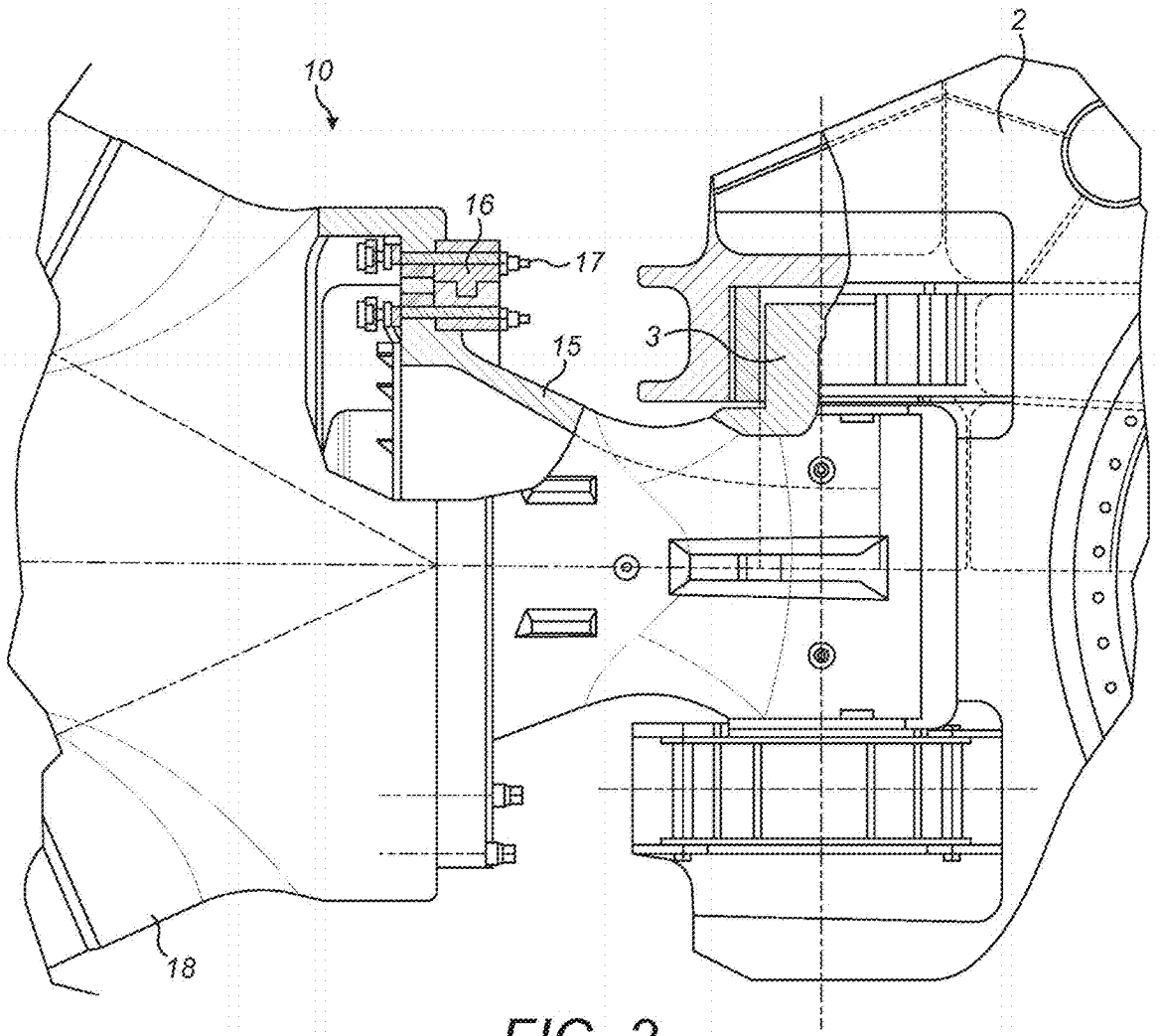
FIG. 2 (Prior Art)
Figure 3:
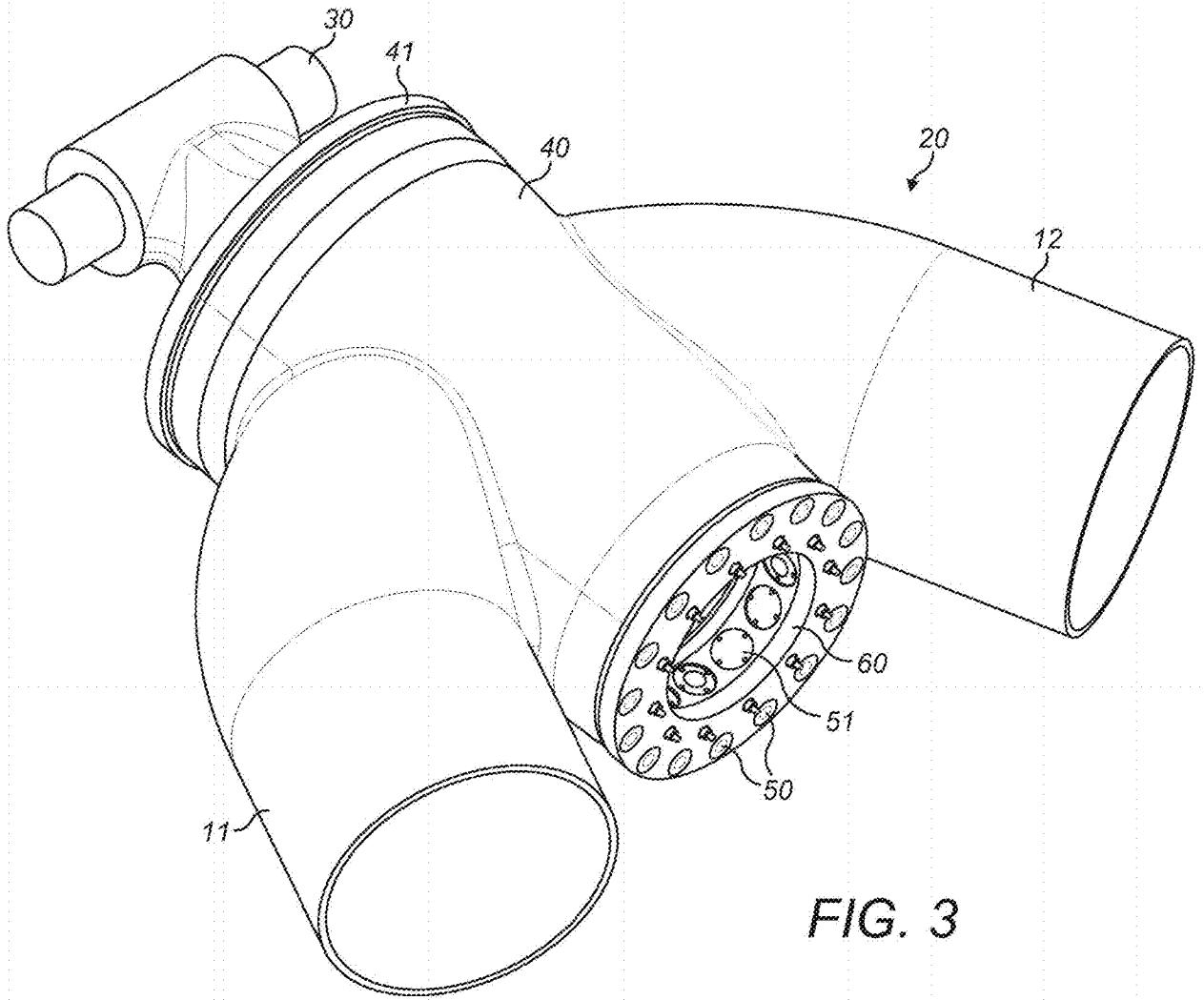
Figure 4:
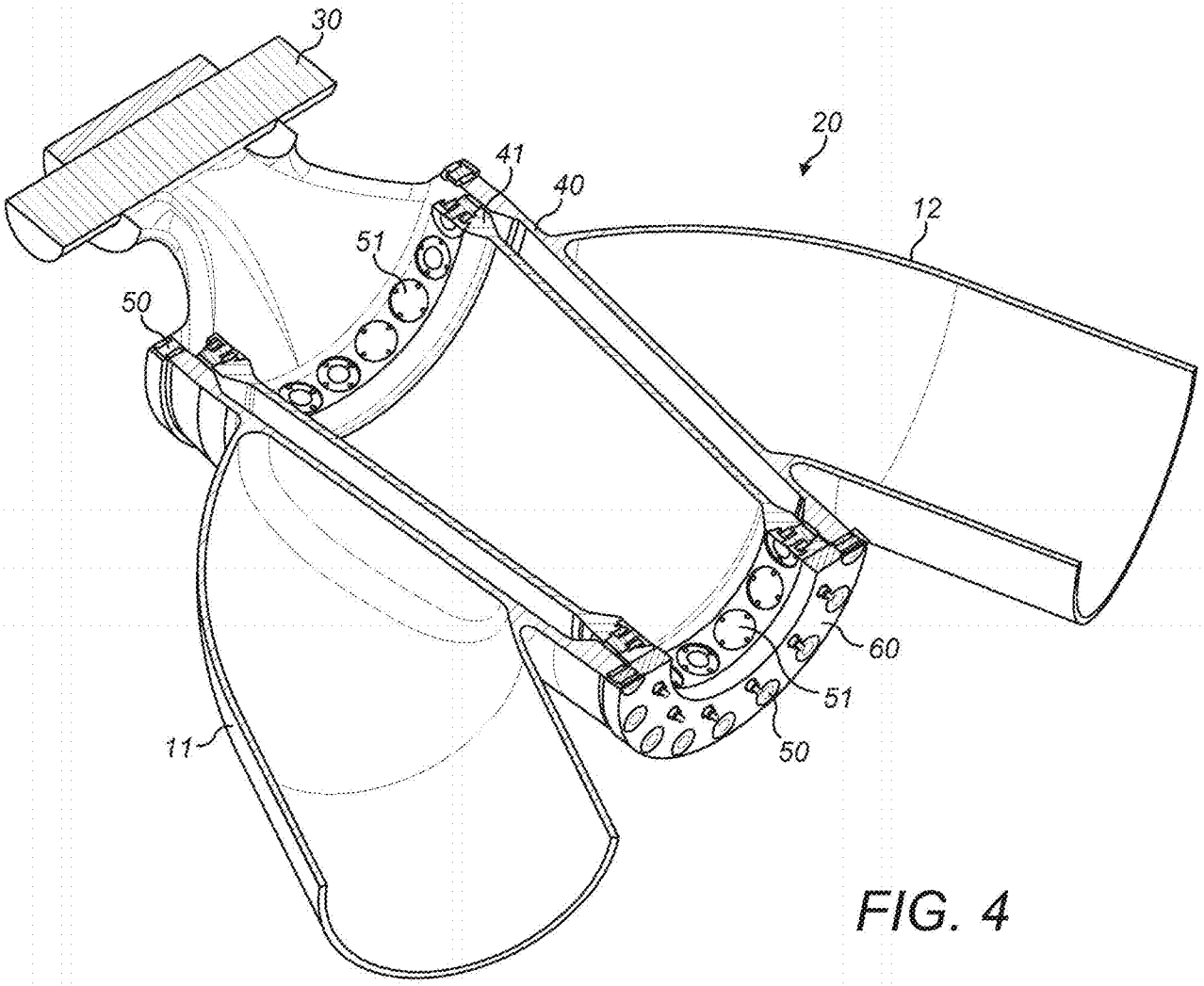
Figure 5:
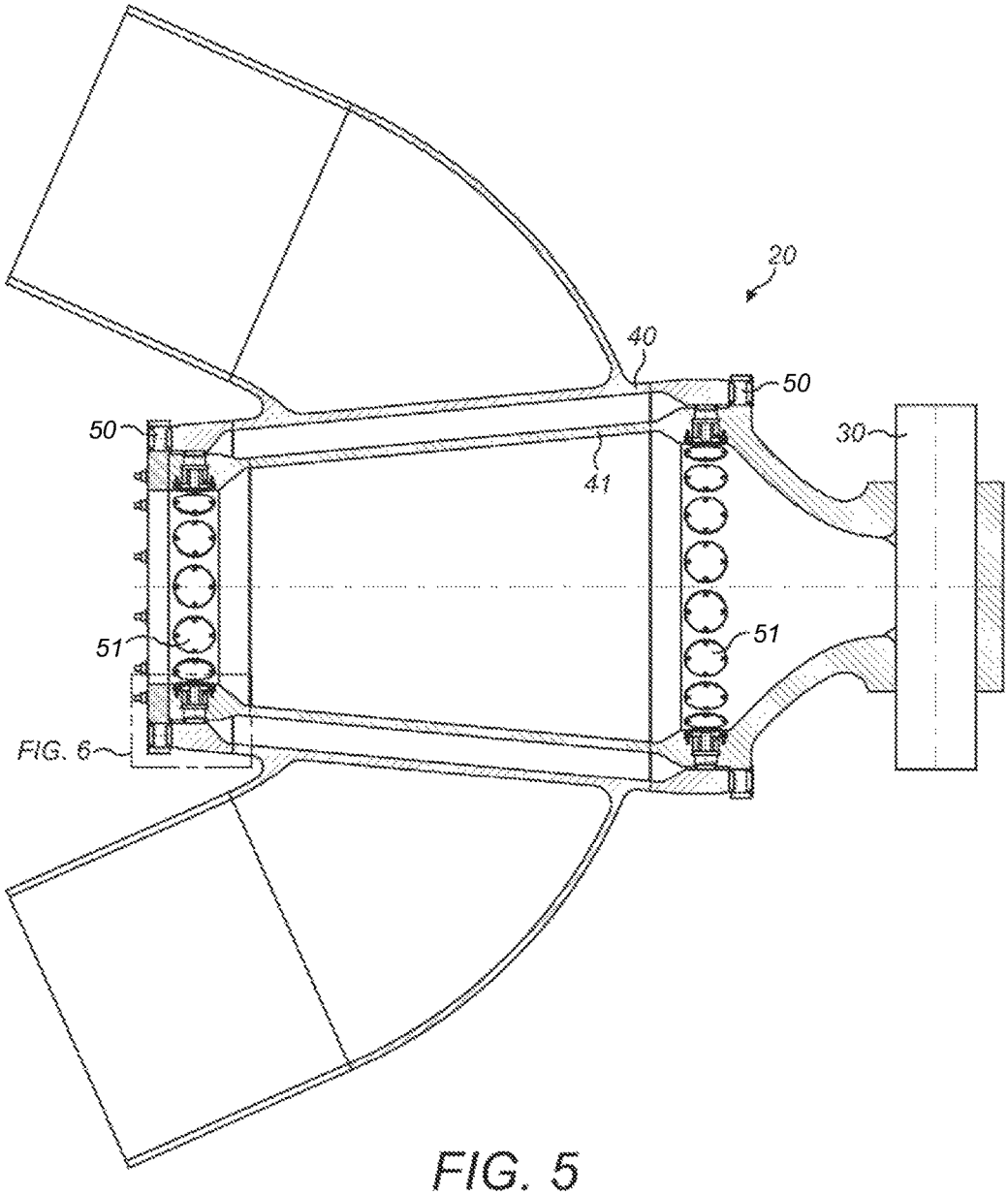
Figure 6:
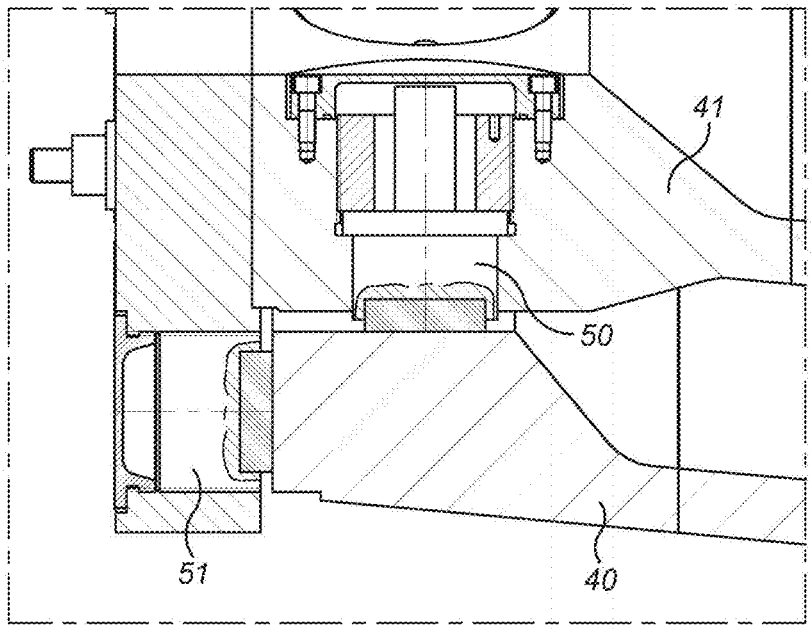
Figure 7:
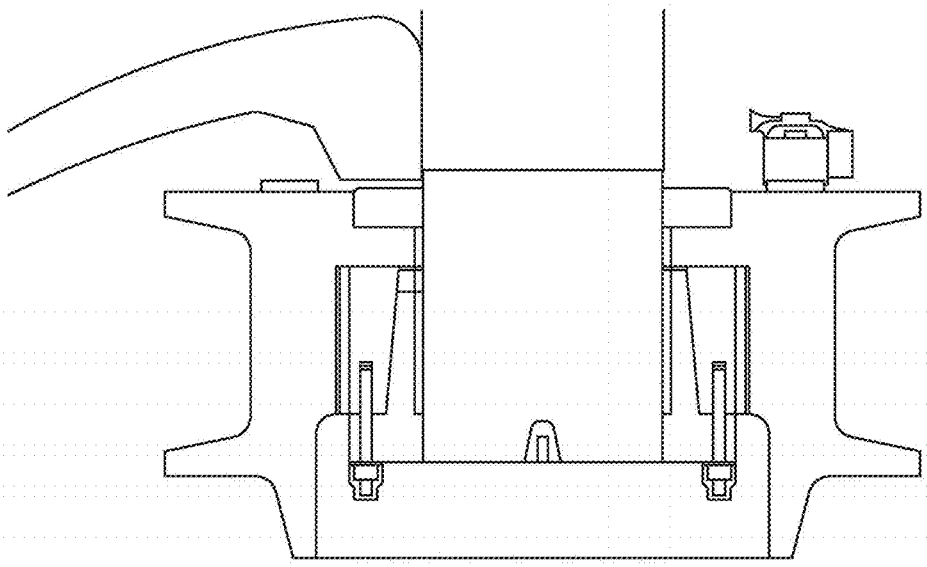
Figure 8:
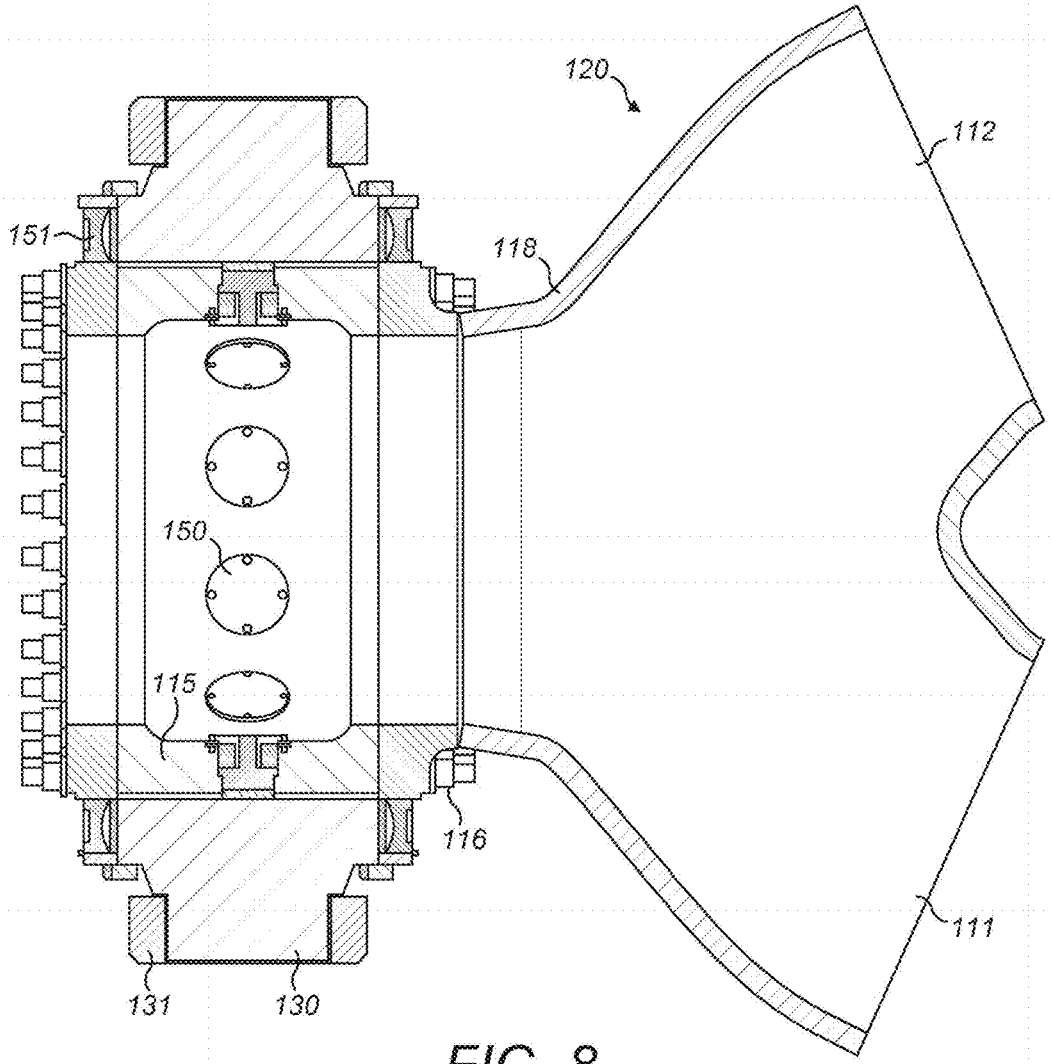

FIG. 1 shows a soft yoke mooring system according to the prior art,

FIG. 2 shows a mooring arrangement comprising an Y-shaped yoke according to the prior art, FIG. 3 shows in perspective the tip of the Y-shaped yoke to be used in the mooring arrangement in a first embodiment of the invention, FIG. 4 shows the tip of the Y-shaped yoke according to FIG. 3, in a view which allows to see the interior of the yoke tip, FIG. 5 shows a cross-sectional view of the Y-shaped yoke tip according to FIGS. 3 and 4, FIG. 6 shows a further detail of the position of the friction elements used in the roll articulation according to the FIGS. 3-5, FIG. 7 shows an alternative pitch articulation for a yoke tip having a removable bush housing, and FIG. 8 shows a cross sectional view of a second embodiment of a Y-shaped yoke tip to be used in the mooring arrangement according to the invention.

FIG. 1 shows a typical soft yoke mooring system, according to the prior art. This soft yoke mooring system is used for mooring a floating structure 1, such as a vessel, to a structure 101 which is fixed on a sea bed. The fixed structure 101 comprises a bottom element which is rotatably connected to a top structure 102. The top element 102 can rotate via a rotating axis with respect to the bottom element 101. The top element 102 is provided with a turntable 2 to connect a Y-shaped yoke. The Y-shaped yoke is provided with a first 11 and a second 12 yoke arm which connect to at least one ballast weight 61. The floating structure 1 is connected to the ballast weight 61 by means of a first and a second mooring leg 41, 41'. The mooring legs 41, 41' and the yoke are hingedly interconnected.

The mooring legs 41, 41' are at their upper ends connected to a support structure 21 via articulation joints 221, 221'allowing rotation of the arms 41, 41' around the horizontal transverse axis and a horizontal longitudinal axis.

FIG. 2 shows an arrangement for connecting a Y-shaped yoke tip to a turntable, according to the prior art. In FIG. 2 parts of the elements are cut away in order to allow better understanding of the drawing.

FIG. 2 shows the connection between the tip of a yoke 10 with a turntable 2. The turntable 2 will be part of a top element, which is rotatable around a vertical axis fixed to a geo-stationary bottom element. The Y-shaped yoke 10 comprises an intermediate element 15. This element 15 is at yoke tip end (left in FIG. 2) connected with the part 18 of the yoke 10 via a roller bearing 16. Part 18 is formed by the connection of the end parts of the two legs (not shown) of the yoke 10. In use, the two yoke arms (not shown) extend from part 18 in the direction of the vessel.

The roller bearing 16 is fixed between the elements 15 and 18 by means of bolts 17. The roller bearing 16 comprises two series of roller elements for transferring forces in the axial direction and one series of roller elements for transferring radial forces. The second end of the intermediate element 15 (right in FIG. 2) comprises a bar 3 which is used for a pitch articulation with the turntable 2.

The roller bearing 16 provides a roll articulation between the part 18 rigidly fixed on one side to the two arms of the yoke 10 and on the other side to part 15, which is including the pitch articulation with the turntable 2. The roller bearing 16 thereby allows rotation of the yoke 10 with respect to longitudinal axis of the yoke 10.

The presence of both the pitch articulation, by means of the bar 3, and the roll articulation, by means of the roller bearings 16, will allow the yoke arms (not shown) of the yoke 10 sufficient freedom to follow any roll and pitch movement of the moored vessel, while the yoke tip is being connected to the turntable 2, and the yoke arms are connected to a vessel. Said vessel will also be able to weathervane around the geo-stationary element thanks to the rotatable fastening between the top and bottom elements.

Field experience has revealed that the arrangement according to FIG. 2 may cause inconveniences. One of the problems is linked to the use of roll bearings 16 which in use may suffer from lack of maintenance due to poor access and poor lubrication. Lubrication issues come from the unusual bearing orientation which is almost vertical. This means that the top rollers/raceways of the roll bearings may not be properly lubricated due to gravity effect moving the lubricant to the lower side of the bearing cavity.

Moreover, accumulation of debris, water ingress and foreign particles at the bottom side of the bearing cavity may accelerate the damage of the rollers/raceways at this location. The lack of continuous or complete revolutions also affects the fatigue capacity of such a roller bearing 16. In case one would need to replace the roller bearing 16, the mooring yoke 10 should be completely disconnected from the turntable 2. Only after the disconnection of the mooring yoke 10, the roller bearing is accessible for maintenance or replacement.

It is an object of the invention to avoid the above mentioned problems relating to the prior art. To realize this, an alternative arrangement is proposed, which is shown is FIG. 3.

In FIG. 3 a first embodiment of a yoke 20 to be used in the arrangement of the invention is shown. FIG. 3 shows the elements 11, 12 to which a first and second arms (not shown) are to be connected. The elements 11, 12 are fixed to the exterior of a conical shaped outer part 40. This outer part 40 is rotatable fixed around an inner part 41 (see for details FIG. 4) which has a similar conical form as the outer part 40.

The internal conical element 41 is connected to a bar 30. The bar 30 is used to form a pitch articulation between the yoke 20 and a receptacle of the top element (not shown).

The conical elements 40 and 41 are rotatable fixed. This means that the element 40 and 41 together provide the roll articulation for the yoke 20.

To allow the relative rotation of the elements 40 and 41, friction pads 50 and 51 are used. The friction pads 50 are used for transferring forces in the radial direction and friction pads 51 are used for transferring forces in axial direction. The positioning of said friction pads 50 and 51 is more clearly visible in FIG. 4.

FIG. 4 shows the connection between the elements 11 and 12 with the outer conical element 40. Moreover, FIG. 4 shows the presence of the conical element 41 inside the conical element 40. A first series of friction pads 50 is provided to transfer radial forces exerted on the mooring yoke 20. The first series of friction pads 50 is fixed by using a circular shaped element 60 which is fixed on the end face of the inner conical element 41 opposite the pitch bar.

A further series of friction pads 50 is provided on the opposite side of the inner conical element 41. The exact positioning of the friction pads 50 on both ends of the conical elements 40 and 41 is more clearly visible in FIG. 5.

FIG. 4 shows that a first series of friction pads 51 is provided near the pitch end of the internal conical element 41 to contact the interior of the corresponding part of the exterior conical element 40. Similarly, the two parts of the conical elements 40, 41 are connected one to the other by means of a second series of friction pads 51, at their opposite end.

The provision of a first conical element 40 and a second conical element 41 with series of friction pads 50 and 51 allows for radial and axial force transfer between the elements 40 and 41. This will allow the yoke 20 to have roll articulation in order to allow rotation of the yoke 20 with regards to the yoke's longitudinal axis. The use of 15 the series of friction pads 50 and 51 allows for a roll articulation which is basically maintenance free because of the fact that the friction pads allow movement of the elements 40 and 41, one with respect to the other, without the need of lubrication.

Another aspect of the arrangement according to the invention is the fact that the friction pads 50 and 51 can be removed and replaced one at a time. At a given time, the friction pads 50, 51 can be removed and replaced in order to safeguard proper functioning of the roll articulation. It might be useful to replace, for instance, every other friction pad while keeping the intermediate friction pads. The removal and the replacement of the friction pad can take place in situ. That means that for a replacement of the friction pads, no shutdown is required. Moreover, the replacement of the friction pad does not need heavy tooling, neither heavy lifts nor other expensive and voluminous apparatuses.

The friction pads 50, 51 are for instance friction pads of the Xytex456 type. The friction pads are maintenance free, wear resistant and suitable for offshore applications. The pad cavities for the friction pads 50 and 51 are normally closed and watertight. This means that a risk for ingress of particles is limited. The wear of the individual pads 50, 51 can be monitored by controlling the alignment (concentricity) of the articulation without opening or dismantling any of the elements of the roll articulation. The pads 50, 51 could, for instance, run on corrosion resistant overlay such as Inconel 625. The wear rate under normal bearing pressure could be in the range of 0.003 mm/km. The anticipated wear should not exceed a couple of millimeters over the full system lifetime. Several millimeters of wear are normally acceptable. Therefore, the selected pads 50, 51 are suitable to meet the required design life of the overall system.

In FIG. 5, a cross-sectional view of the yoke 20, according to FIGS. 3 and 4 is shown. FIG. 5 shows the presence of a first series of friction elements 51 and a second series of friction elements 51 at opposite ends of the conical elements 40 and 41 for axial forces. Moreover, the friction elements 50 on opposite ends of the conical elements 40 and 41 are visible for transfer of radial forces.

FIG. 6 provides a detailed view of the positioning of the friction elements 50 and 51 between the conical elements 40 and 41 at the end of the conical having their minimum diameter.

In FIG. 7, an alternative for the pitch articulation is shown. A pitch articulation is provided with a removable bush housing to allow easy in situ change out of the bush.

In FIG. 8, a second embodiment of a yoke 120 to be used in a mooring arrangement according to the present invention is shown. FIG. 8 shows only the tip part of the Y-shaped yoke 120. Reference numbers 111, 112 refer to the ends of the yoke arms (not shown) of the yoke 120. The tip end parts of both-arms 111, 112 are rigidly connected together and form one combined termination for both arms, part 118. Part 118 is connected by means of bolts 116 to an intermediate element 115 which provides both pitch and roll articulation. The roll articulation is provided via friction pads 150 which are transferring radial forces between the intermediate part 115 and element 130, and friction pads 151, which are transferring axial forces between part 118 and element 130.

Element 130 is provided with two opposite extensions to allow the element 130 to form a pitch articulation in combination with the element 131. In use, the end part of the yoke formed by elements 115 and 118 will be able to provide rotational freedom of the yoke with respect to intermediate element 130. The element 130 itself will also be able to provide pitch articulation, between the yoke and the turntable in the top element.

As shown in FIG. 8, only a single series of friction pads 150 is used, because of the specific configuration of the different elements constituting the roll articulation. According to FIG. 8 there is no need to split the function of transferring radial forces between a first or a second series of friction pads. However, transfer of axial forces definitely needs two series of friction pads 151.

The invention claimed is:

1. An arrangement for mooring, loading and unloading of a vessel, comprising:

a structure connected to the seabed, the structure comprising a stationary bottom element adapted to be fixedly connected to the sea bed and a top element having a rotatable fastening to the bottom element;

a Y-formed yoke having a first and a second arm for connecting the vessel to the structure, the top element being connected to the yoke, through both a yoke tip pitch articulation, positioned between a turntable and the yoke tip; and a roll articulation positioned between the pitch articulation and the first and second yoke arms, to allow the yoke arms to rotate along a longitudinal axis of the yoke with respect to the pitch articulation, the roll articulation comprising a first outer and a second inner articulation element rotatable fixed one around the other along said longitudinal axis of the yoke, wherein the first outer and the second inner articulation elements are connected by means of friction pads positioned in between the first and second articulation elements, with a first series of friction pads arranged for transfer of radial forces between the first and second articulation elements and a second series of friction pads arranged for transfer of axial forces between the first and second articulation elements, wherein the first series of friction pads comprise a first annular arrangement of friction pads between the first outer and the second inner articulation element proximal to the pitch articulation and a second annular arrangement of friction pads between the first outer and the second inner articulation element at an end of the roll articulation distal from the pitch articulation.

2. The mooring arrangement according to claim 1, wherein the first articulation element of said roll articulation is rigidly connected to the yoke tip and wherein the second articulation element of said roll articulation is rigidly connected to said first and second yoke arms.

3. The mooring arrangement according to claim 2, wherein the first and the second roll articulation elements are essentially conically shaped.

4. The mooring arrangement according to claim 2, wherein both yoke pitch and roll articulations are combined into one assembly.

5. The mooring arrangement according to claim 2, wherein the friction pads are adapted to be removed and replaced one at a time, in situ, without requiring shutdown.

6. The mooring arrangement according to claim 1, wherein the first and the second roll articulation elements are essentially conically shaped.

7. The mooring arrangement according to claim 6, wherein both yoke pitch and roll articulations are combined into one assembly.

8. The mooring arrangement according to claim 6, wherein the friction pads are adapted to be removed and replaced one at a time, in situ, without requiring shutdown.

9. The mooring arrangement according to claim 1, wherein both yoke pitch and roll articulations are combined into one assembly.

10. The mooring arrangement according to claim 9, wherein the friction pads are adapted to be removed and replaced one at a time, in situ, without requiring shutdown.

11. The mooring arrangement according to claim 1, wherein the friction pads are adapted to be removed and replaced one at a time, in situ, without requiring shutdown.

12. The mooring arrangement according to claim 1, wherein the inner articulation element is attached to a bar.

13. The mooring arrangement according to claim 1, wherein the friction pads are in pad cavities that are closed and watertight.

* * * * *